US005664355A

United States Patent [19]

Ronkainen

[11] Patent Number: 5,664,355

[45] Date of Patent: Sep. 9, 1997

[54] DETACHABLE AMMUNITION MAGAZINE

[75] Inventor: James W. Ronkainen, Elizabethtown, Ky.

[73] Assignee: Remington Arms Company, Inc., Madison, N.C.

[21] Appl. No.: 579,100

[22] Filed: Dec. 27, 1995

[51] Int. Cl.[6] ..... F41A 3/00

[52] U.S. Cl. ..... 42/18; 42/22; 42/50

[58] Field of Search ..... 42/18, 22, 50

[56] References Cited

U.S. PATENT DOCUMENTS

| | | | |
|---|---|---|---|
| 3,094,803 | 6/1963 | Green | 42/18 |
| 3,745,687 | 7/1973 | Koon | 42/19 |
| 3,905,142 | 9/1975 | Haskell | 42/18 |
| 3,964,199 | 6/1976 | Musgrave | 42/50 |
| 4,213,262 | 7/1980 | Badali | 42/50 |
| 4,237,638 | 12/1980 | Trexler | 42/6 |
| 4,356,653 | 11/1982 | Swieskowski | 42/50 |
| 4,360,985 | 11/1982 | Pitzen | 42/6 |
| 4,397,108 | 8/1983 | Musgrave | 42/50 |
| 4,450,641 | 5/1984 | Bullis et al. | 42/18 |
| 4,502,237 | 3/1985 | Krogh | 42/50 |
| 4,765,081 | 8/1988 | Dieringer | 42/50 |
| 5,056,252 | 10/1991 | Velezis | 42/50 |
| 5,099,595 | 3/1992 | Chestnut et al. | 42/50 |

*Primary Examiner*—J. Woodrow Eldred
*Attorney, Agent, or Firm*—Huntley & Associates

[57] ABSTRACT

A detachable multiple round ammunition magazine with improved "X" shaped magazine spring and improved latching mechanism.

17 Claims, 3 Drawing Sheets

DETACHABLE AMMUNITION MAGAZINE

BACKGROUND OF THE INVENTION

This invention relates generally to firearms and more particularly to an improved ammunition magazine. Magazines carrying several rounds of ammunition have long been used for a wide variety of firearms. Some magazines are built into the weapon itself while others, the present invention included, are a detachable accessory.

A continuing need exists for firearms that are quickly and easily loaded, especially given the fact that the user may be wearing gloves or otherwise encumbered during the operation of the firearm. As a result, effort has been directed in the past to the development of an ammunition magazine which is easy to load, as well as being easy to insert and remove. The importance of a magazine that can be quickly and easily removed from the firearm, loaded, and reinserted will be evident to hunters and firearm enthusiasts.

SUMMARY OF THE INVENTION

The present invention provides a means for quick and easy loading of a firearm made possible by an improved latching mechanism of the magazine. The latching system enables ambidextrous, one handed removal and insertion of the magazine, even with a gloved hand. The latching mechanism, as well as an improved spring within the magazine, also increase the reliability of the firearm. Reliability is further increased by positioning the latching mechanism perpendicular to the plane of recoil created by the discharge of the firearm, thus reducing the likelihood that the magazine will be ejected from the firearm by the recoil of the gun.

In a firearm having a frame including a magazine well having front, rear, and side walls and having slots formed in the side walls, a detachable ammunition magazine comprising a base attached to front, rear, and two side walls and having latching means positioned on the side walls to engage the slots and secure the magazine within the well, _the magazine walls and the base forming a substantially rectilinear chamber, the chamber being open topped and adapted to retain a plurality of cartridges in stacked relation, a follower positioned within the chamber above the magazine base for support of cartridges, an X-shaped spring of unitary construction positioned between the magazine base and the follower to bias the follower upward, the spring comprising a central portion and four substantially parallel legs attached to the central portion, including two diagonally opposite longer legs extending upward and towards each other to form an "X" when viewed in profile, the longer legs each having a terminal end which forms a substantially perpendicular shoe to support the bottom of the follower, and two diagonally opposite shorter legs in substantially the same plane as the central portion of the spring, positioned to press against the magazine base.

DETAILED DESCRIPTION OF THE INVENTION

The present invention will be more fully understood by reference to the drawings, which show one embodiment of the magazine. Variations and modifications of this embodiment can be substituted without departing from the principles of the invention, as will be evident to those skilled in the art. In the several drawings, the same numbers are used for like elements.

Figure 1:
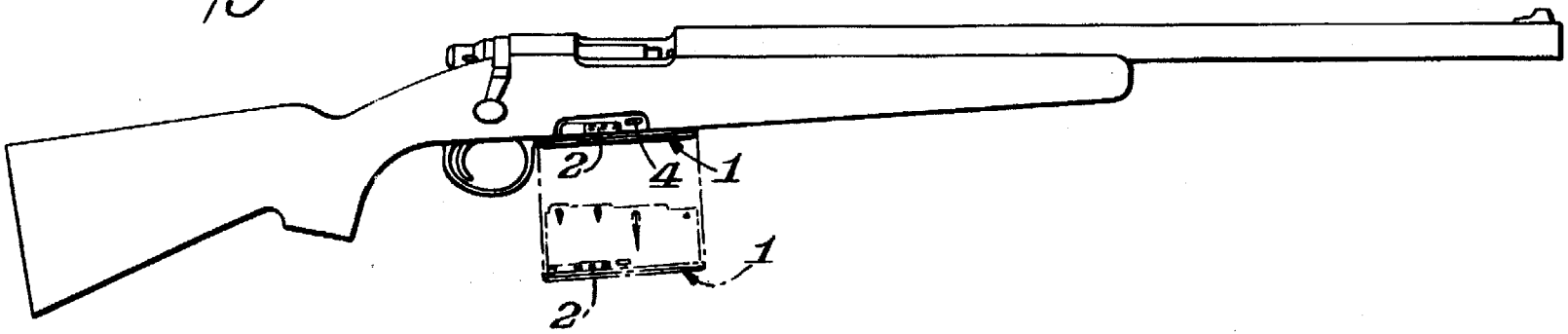
FIG. 1 is a side elevational view of a firearm showing a magazine of the invention.
Figure 5:
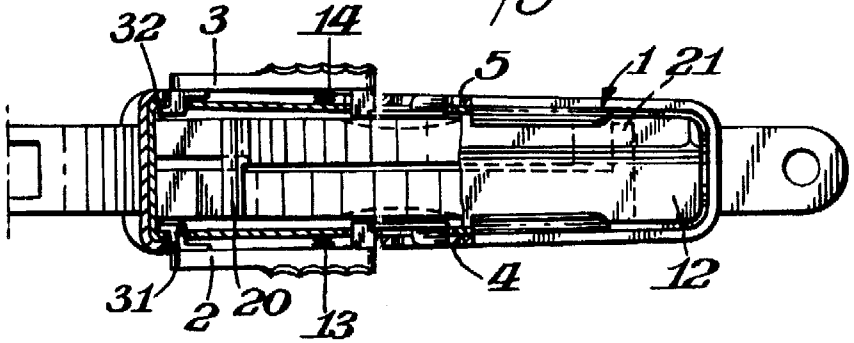
FIG. 5 is a top plan view of the magazine positioned within a magazine well partially broken away to show the operation of the latching mechanism and part of the magazine spring.
Figure 6:
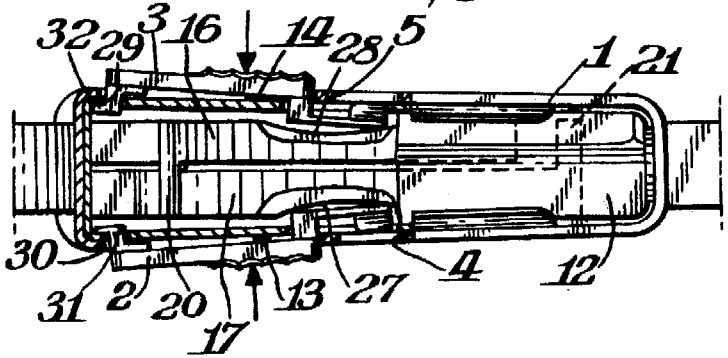
FIG. 6 is a top plan view of the magazine positioned within a magazine well showing the latches in the depressed position.

In the drawings, FIG. 1 is a side elevational view of a firearm showing the magazine 1 secured within the magazine well of a firearm. The magazine has latches 2 and 3 on its side walls, each latch including a latch tab 2A and 3A, the latch tabs interacting with corresponding slots 4 and 5 in each side of the walls of the well to secure the magazine. The magazine is removed from the well by operation of the latches, which release the latch tabs from the slots. FIG. 1 shows the magazine in phantom as if it had been removed from the firearm.

Figure 2:
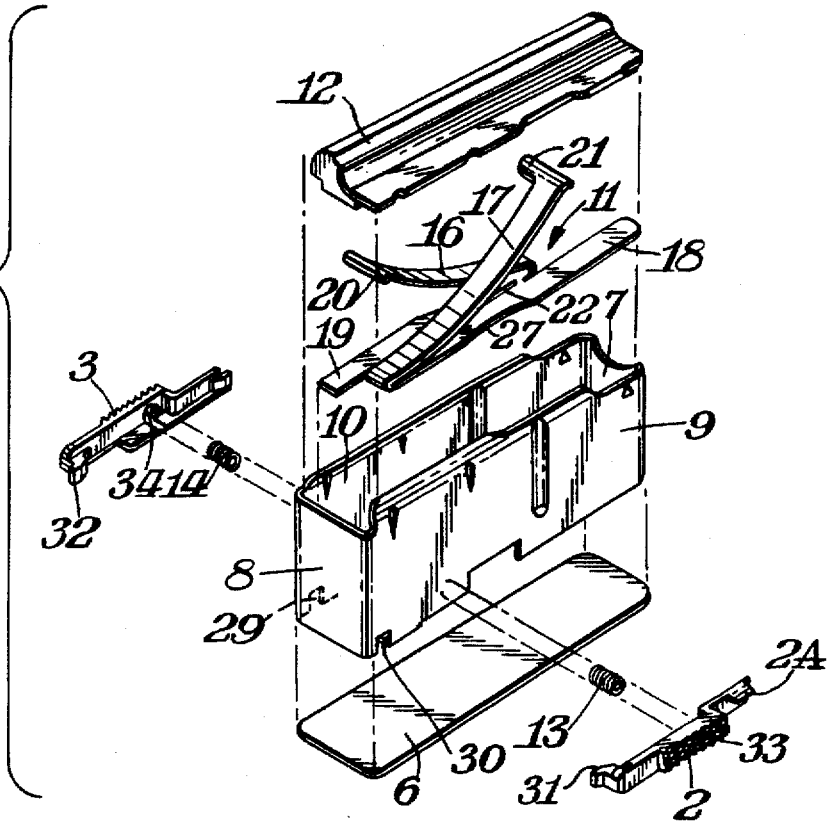
FIG. 2 is an exploded view of the magazine and its component parts.
Figure 4:
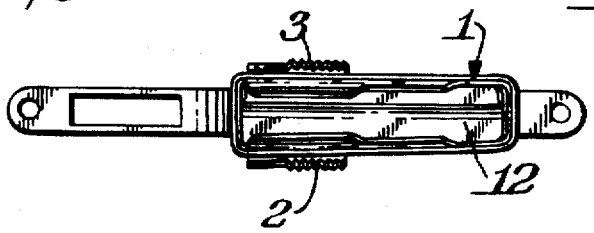
FIG. 4 is a top plan view of FIG. 3.
Figure 7:
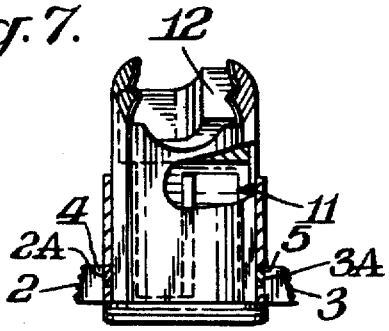
FIG. 7 is a right end elevational view of FIG. 5.
Figure 3:
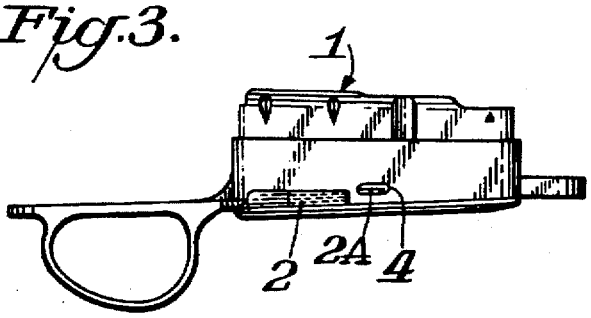
FIG. 3 is a side elevational view of the magazine within a trigger guard assembly.
Figure 8:
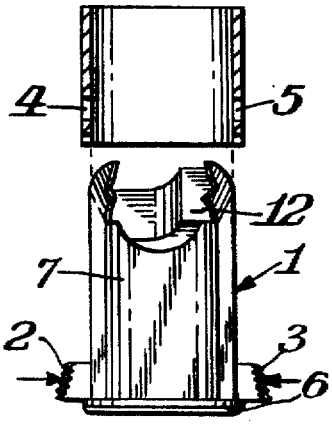
FIG. 8 is a right end elevational view of FIG. 6.

FIG. 2 is an exploded view of the magazine and its components including base 6, front, rear and two side magazine walls 7, 8, 9, and 10, connected to the base to form the magazine chamber, "X" shaped magazine spring 11, magazine follower 12, the latches and latch springs 13 and 14.

Figure 9:
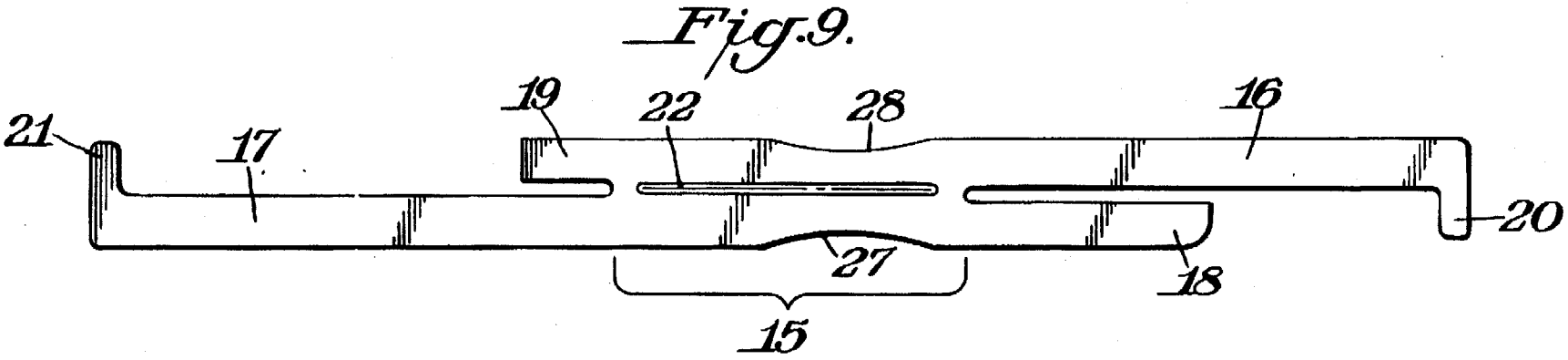
FIG. 9 is a top plan view of the pattern layout for the magazine spring.
Figure 11:
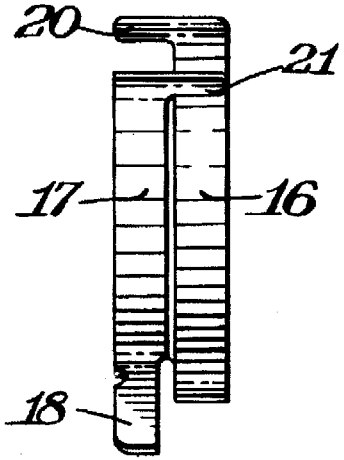
FIG. 11 is a right side elevational view of the magazine spring.
Figure 10:
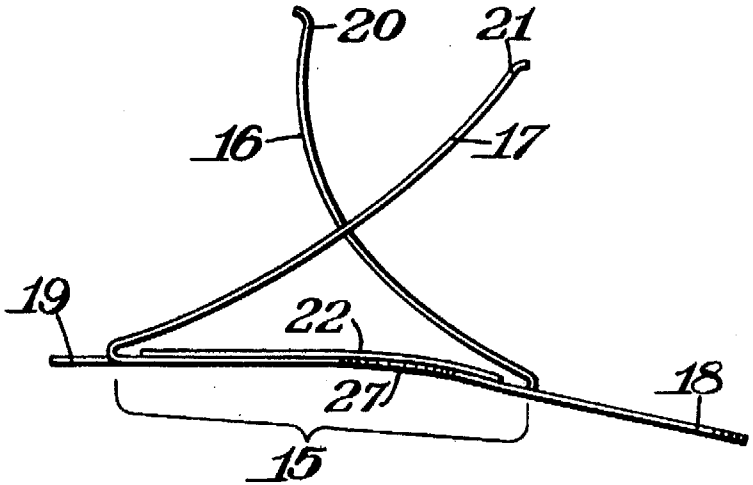
FIG. 10 is a side elevational view of the magazine spring.

Within the chamber, the "X" shaped magazine spring is positioned between the magazine base and the follower, and biases the follower upward to feed ammunition into the receiver. FIG. 9 shows the magazine spring in its original configuration, prior to being shaped into its final form. In its original configuration, the spring has a central portion 15 and four substantially parallel legs. These include two diagonally opposite longer legs 16 and 17, and two diagonally opposite shorter legs 18 and 19. The shorter legs remain in substantially the same plane as the central portion of the spring, while the longer legs are cambered and extend upwards and towards each other to form an "X" when these legs are viewed in profile, as shown in FIG. 10. The terminal end of each longer leg extends perpendicularly to form a shoe 20 and 21, which supports the follower. The perpendicular extension of each shoe provides a wider support for the follower than the leg by itself, thus increasing the magazine's reliability by supplying support to the follower evenly.

The central portion of the spring is preferably arched upward so that only the ends of the two shorter legs will contact the magazine base when there is no lead on the spring. When the spring is compressed, the central portion and the shorter legs become flat and rest against the magazine base. A stiffening rib 22, preferably provided on the central portion is substantially parallel to the legs and provides added rigidity, thereby increasing the period during which spring remains flexible. The central portion of the magazine spring also preferably has notches 27 and 28 formed in each side to provide clearance for the latches when they are compressed to release the magazine.

Latches, to retain the magazine within the firearm, are attached to each side wall of the magazine by tabs 29 and 30 formed in the walls and which are positioned to engage mating projections 31 and 32 on each latch. The tabs are folded over the mating projections to secure each latch within the magazine, and to enable the latches to pivot. As the latches pivot, slots in each of the magazine side walls and the notches in the magazine spring permit the latches to be compressed. Latch springs 13 and 14 between the latch and the magazine side walls are preferably retained in position within a bore 33 and 34 on each latch. The latch springs bias each latch outwardly to engage the slots in the well and secure the magazine within the firearm until the magazine is released by the depression of the latches.

The improved mechanism of the present invention, in its various possible embodiments, provides the following desirable combination of advantages.

The present invention provides a magazine latch system whereby changing magazines can be easily and rapidly accomplished. Previously, detachable ammunition magazines have been provided with spring biased latch mechanisms to lock the magazine in place. This has made necessary a manually operated push button or lever to unlatch the magazine and thereby causes some delay in the replacing of loaded magazines. Such magazines also are difficult to remove at night when visibility is restricted and during very cold weather when gloves are worn. The present invention provides a magazine that can be easily and quickly removed from or inserted into the firearm without the necessity of visually observing the latch members or removing one's gloves. The magazine is designed to permit ambidextrous, one handed operation of the latching mechanism, and also offers flexible loading options. The magazine can be loaded prior to insertion into the firearm, and can also be loaded while inserted into the firearm.

The act of depressing the latches not only disengages the latches from the slots in the magazine well, but also causes the fingers to apply a downward force to the magazine, starting its motion downward and out of the firearm. The design and placement of the latches also significantly increase reliability. The operational motion of the latches is out of the plane of recoil of the firearm, and the potential for malfunction is reduced. Many previous magazine latching mechanisms operate in the plane of recoil, which makes them subject to severe inertial loads. The inertial loads on the latching mechanisms can cause them to move in a manner that unlatches the magazine from the firearm.

Another improvement provided by the present invention is the capability of the magazine spring to precisely control the point of load application in the firearm. A conventional type magazine with a rectangularly coiled spring faces a problem of spring buckling and high stress concentrations at sharp radii of the spring, which can result in spring failure. The coiled springs in a conventional magazine are especially susceptible to buckling and distortion at the follower end. Such buckling and distortion cause the point of load application to shift during firing when the spring is feeding and extending in an interrupted sequence. The X-shaped magazine spring is not susceptible to spring buckling or other similar causes of spring failure, and, by controlling the point of load, misplacement of load application is prevented. The misplacement of load application is more common in magazines with conventional coiled springs and leads directly to firing malfunctions in the firearm. The present invention provides a solution to the problems associated with prior biasing mechanisms within the magazine chamber. The unique design of the "X" shaped spring independently adjusts the spring load and rate applied to the front and rear of the magazine follower.

I claim:

1. In a firearm having a frame including a magazine well having front, rear, and side walls and having slots formed in the side walls, a detachable ammunition magazine comprising a base attached to front, rear, and two side walls and having latching means positioned on the side walls to engage the slots and secure the magazine within the well, the magazine walls and the base forming a substantially rectilinear chamber, the chamber being open topped and adapted to retain a plurality of cartridges in stacked relation, a follower positioned within the chamber above the magazine base for support of cartridges, a spring of unitary construction positioned between the magazine base and the follower to bias the follower upward, the spring comprising a central portion and four legs attached to the central portion and substantially parallel in the original configuration of the spring, including two diagonally opposite longer legs extending upward and towards each other to form an "X" when viewed in profile, the longer legs each having a terminal end which forms a substantially perpendicular shoe to support the bottom of the follower, and two diagonally opposite shorter legs in substantially the same plane as the central portion of the spring, positioned to press against the magazine base.

2. A magazine of claim 1 wherein the central portion of the spring is arched upwards.

3. A magazine of claim 2 wherein the central portion of the spring further comprises a stiffening rib, the rib being substantially parallel to the legs.

4. A magazine of claim 3 wherein each side of the central portion of the spring further comprises notches, the notches positioned to allow the latches to be compressed without contacting the central portion of the spring.

5. A magazine of claim 4 wherein the central portion of the spring and the two shorter legs comprise the base of the spring.

6. A magazine of claim 1 wherein the two shorter legs of the spring are of unequal length.

7. A magazine of claim 1 wherein each of the two shorter legs of the spring has an end to maintain the position of the spring with respect to the follower and the magazine base.

8. A magazine of claim 1 wherein the two longer legs of the spring are of unequal length.

9. A magazine of claim 1 further comprising at least one dimple in each side wall adapted to position cartridges within the magazine.

10. A magazine of claim 9 further comprising means in the side wall to retain the follower within the chamber.

11. A magazine of claim 1 wherein the latching means comprises at least one latch on each side of the magazine, each latch further comprising a mating projection at one end.

12. A magazine of claim 11 wherein each latch comprises a tab positioned to engage a slot within the magazine well.

13. A magazine of claim 12 wherein each latch is pivotally mounted on the magazine.

14. A magazine of claim 13 having a slot on each side of the wall to permit each latch to be inwardly compressed.

15. A magazine of claim 1 wherein the magazine well is formed in a trigger guard assembly.

16. A magazine of claim 15 wherein the slots are in the trigger guard assembly.

17. A magazine of claim 1 wherein the side walls are curved inwardly at the top.

* * * * *